United States Patent [19]

de la Cruz

[11] 4,129,982

[45] Dec. 19, 1978

[54] MERCURY SWITCH ARRANGEMENT FOR DIGITAL WATCH

[76] Inventor: Virgil de la Cruz, 67 Byram Shore Rd., Greenwich, Conn. 06830

[21] Appl. No.: 775,448

[22] Filed: Mar. 8, 1977

[51] Int. Cl.[2] ..... G04C 3/00; G04B 19/24

[52] U.S. Cl. ..... 58/23 R; 58/4 A; 58/58; 200/61.47

[58] Field of Search ..... 58/4 A, 23 R, 50 R, 58/58; 200/61.45 R, 61.47

[56] References Cited

U.S. PATENT DOCUMENTS

| | | | |
|---|---|---|---|
| 3,232,119 | 2/1966 | Salerno | 200/61.47 |
| 3,871,170 | 3/1975 | Bergey | 58/50 R |
| 3,921,385 | 11/1975 | Harding et al. | 58/50 R |
| 3,974,638 | 8/1976 | Haber | 58/50 R |
| 4,051,662 | 10/1977 | O'Connor et al. | 58/4 A |

*Primary Examiner*—Edith S. Jackmo

*Attorney, Agent, or Firm*—Alfred E. Miller

[57] ABSTRACT

An automatically operating switch for activating the display of an LED digital wrist watch. The orientation of the wearer's wrist determines each of the various functions of the watch that are visually displayed. A curved tube of a non-wetting type is provided for housing a mercury bead. The position of the tube can be manually adjusted within the watch case in order to alter the response characteristics of the switch.

14 Claims, 10 Drawing Figures

Fig. 1.
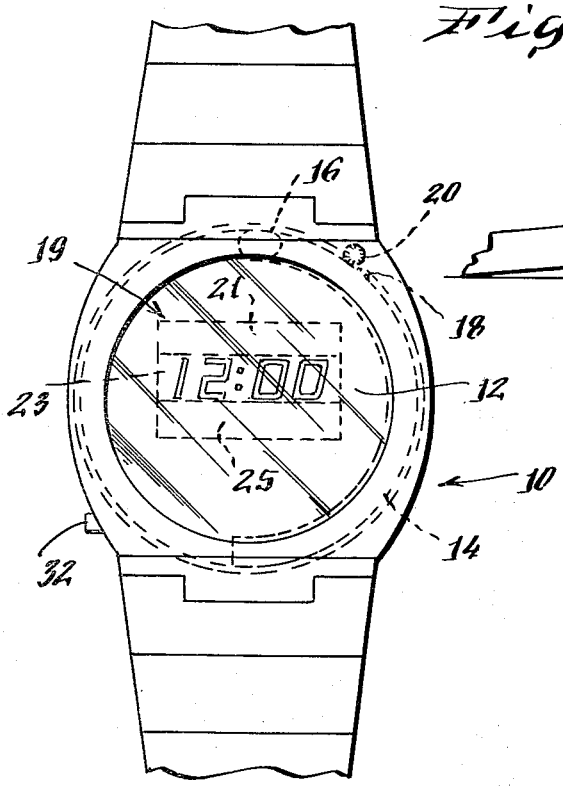
Fig. 2.
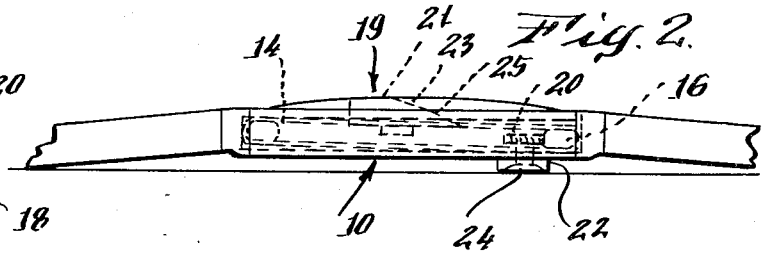
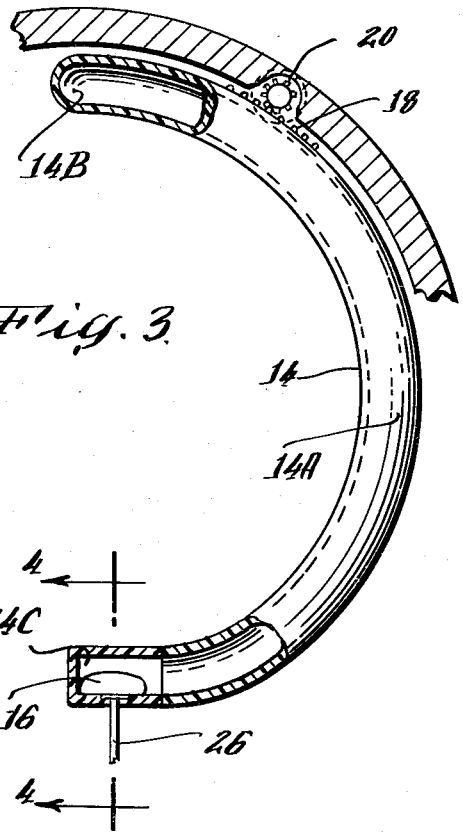
Fig. 3.
Fig. 4.
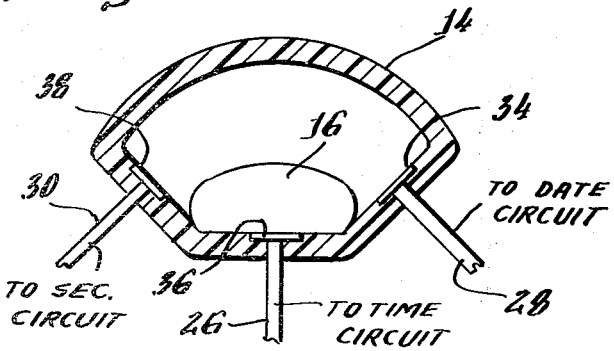
Fig. 6.
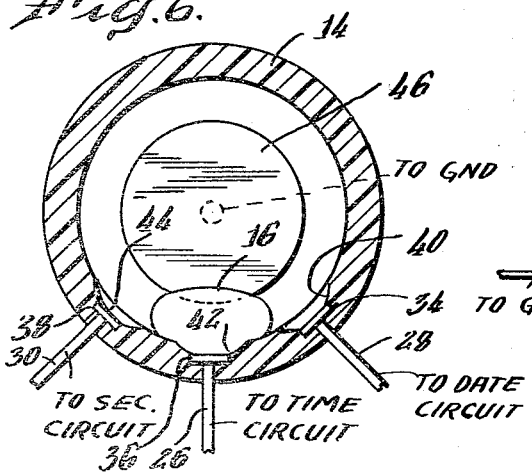
Fig. 5.
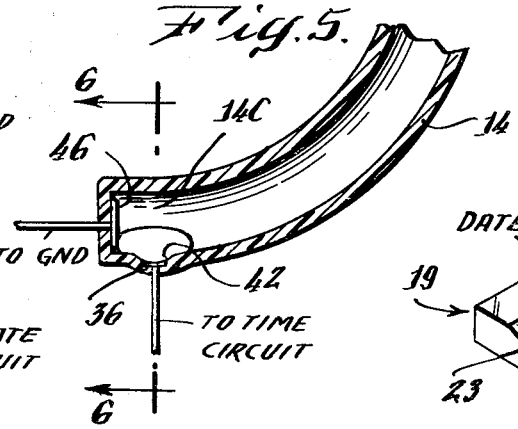
Fig. 7.
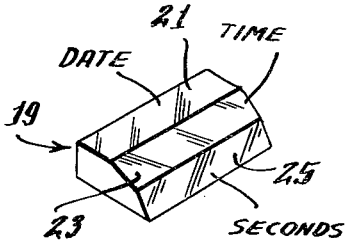

Fig. 8.
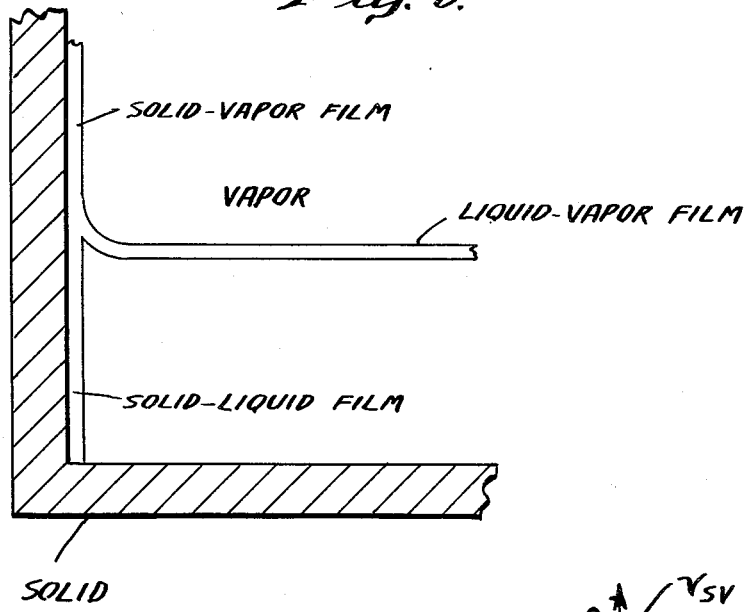
Fig. 9.
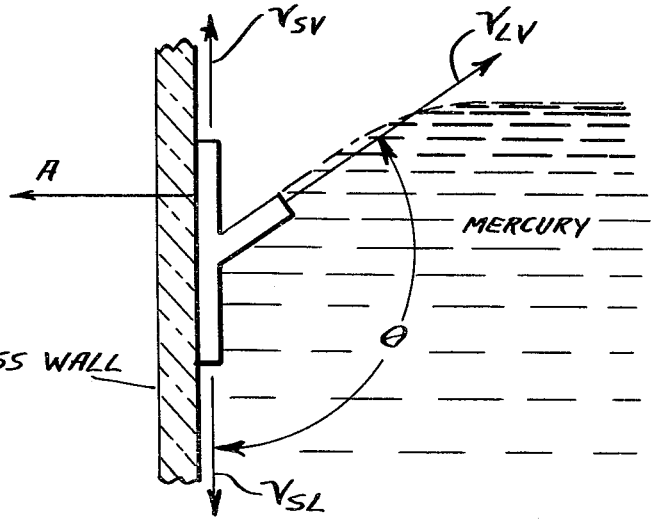
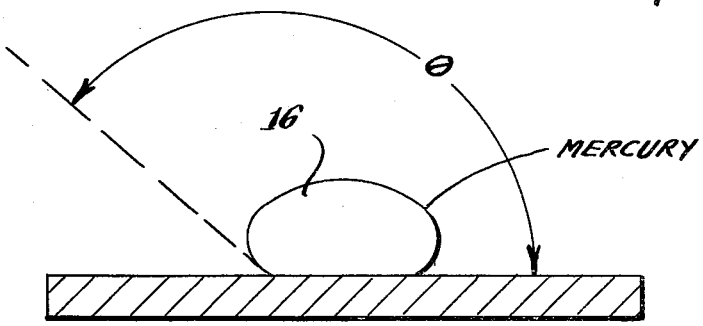
Fig. 10.

MERCURY SWITCH ARRANGEMENT FOR DIGITAL WATCH

BACKGROUND OF THE INVENTION

Digital wrist watches, and especially the LED type, require the physical act of pressing a button, or other activating means, in order to cause the visual display of the time, date, month, as well as additional functions, carried out by known digital wrist watches. It is also well known that the requirement of depressing a button in order to exhibit the time display has caused a lack of acceptance by many potential purchasers of LED digital wrist watches. Therefore, it is evident that an LED wrist watch having a visual display activated automatically by the normal arm and wrist movement of a person viewing his watch would be of great significance in achieving mass acceptance of the LED digital wrist watch.

The present invention relates to LED digital wrist watches, and especially to a mercury switch arrangement which automatically actuates the watch display into one or more functions.

It is an object of the present invention to provide a non-wetting, curved sealed glass or Teflon tube having a mercury globule or bead therein. The mercury bead will constantly seek the lowest point in the tube due to the influences of gravity. Electrical contacts are so placed in a curved tube that when the wrist watch is held at a normal viewing angle, the mercury bead will move to a predetermined position in the curved tube whereby the electrical contacts are engaged, thus actuating the digital watch display.

It is another object of the present invention to fill the curved tube housing the mercury bead with a selected medium which is dependent upon the response time sought, such as vacuum or air for fast response, or oil, or other viscous medium, for slow response.

A further feature of the present invention is to provide an additional disabling switch for the digital watch display circuit so that the display will not be activated when the watch is not being worn, but is being carried, for example in a briefcase or a traveling bag. This feature prevents an unwanted current drain of the digital watch battery when the watch is not being worn.

It is another object of the present invention to provide a curved tube of non-wetting metal, said tube accommodating a mercury bead and having the walls of the tube function as one of the electrical leads.

It is a further object of the present invention to provide a metal sphere or ball in a curved glass or thermoplastic tube, the latter being provided with spaced depressions with electrical contacts therein, whereby said metal sphere may roll by means of gravity into a selected depression and activate the digital display, depending upon the watch wearer's arm and wrist orientation.

In order that the invention will be more clearly understood, it will now be disclosed in greater detail with reference to the accompanying drawings, in which:

FIG. 1 is a front elevational view of an LED digital wrist watch employing an automatic mercury switch arrangement constructed in accordance with the teachings of my invention;

FIG. 2 is a side elevational view of the wrist watch and mercury switch arrangement shown in FIG. 1;

FIG. 3 is an enlarged sectional view of a detail of construction, including the mercury switch arrangement, and the means for adjusting the arrangement;

FIG. 4 is an enlarged sectional view taken along the lines 4—4 of FIG. 3;

FIG. 5 is a fragmentary sectional view of another embodiment of my invention;

FIG. 6 is an enlarged cross-sectional view of the embodiment of the invention shown in FIG. 5;

FIG. 7 is an enlarged perspective view of the prismatic viewing lenses illustrated in phantom lines in FIGS. 1 and 2; and FIGS. 8, 9 and 10 are graphical views or representations showing the characteristics of a mercury droplet or bead on a surface it does not wet.

DESCRIPTION OF THE PREFERRED EMBODIMENTS

Referring to FIGS. 1 and 2, a digital wrist watch of the LED type is shown, and is referred to generally by the reference numeral 10. The watch 10 is provided with the usual integrated circuits and has a display 12 for the various functions thereof. These functions may take the form of the time, seconds, day, date, and month. In order to eliminate the need to press a button or some other activating device in order to actuate the various functions of this digital watch, a specially designed and arranged mercury switch is incorporated therein. The mercury switch takes the form of a curved glass or plastic tube 14 in which a mercury bead or globule 16 is housed. As seen in FIG. 3, the tube 14 may be adjustable in a curved path by means of a rack 18 on the exterior of the tube 14 which mates with the pinion or worm 20. In FIG. 2 the worm 20 is shown provided with a shaft 22, and a slotted head 24. The slotted head is located on the exterior surface of the back of the digital watch 10, and accessible from the rear thereof. In order to permit clarity of viewing of the various functions of the digital watch a prismatic lens bearing the general reference numeral 19 is shown in FIGS. 1, 2 and 7 having an upper viewing surface 21 for the date function, an intermediate viewing surface 23 for observing the time, and a lower viewing surface 25 for the second function.

The principle of operation of the mercury bead 16 in the curved glass or plastic tube 14 is such that the mercury bead will seek the lowest point in the tube, in response to the pull of gravity. Thus, contacts, such as contacts 26 to the time circuit, as seen in FIG. 4, will be closed when the wrist of the wearer is held in the normal viewing angle, thus activating the time display. Moreover, if the wearer's wrist is turned to the right a slight amount, the date display will be activated; similarly, if the wearer's wrist is turned a slight amount to the left, the seconds circuit will be activated, all as shown in FIG. 4. It should also be noted from observing FIG. 2 that the curved glass or plastic tube is set at an orientation or angle relative to the horizontal plane so that when the wrist watch is laid flat, for example, on a table, the mercury bead will seek the lowest point in the curved tube, which in this case is at the direct opposite position to the location of the contacts shown in FIG. 4 and is at approximately 2°–4°.

Furthermore, it should be noted that the properties of the mercury switch can be varied to match the electrical characteristics of the watch. Thus, the speed of actuation of the contacts can be changed dependent upon the response time sought, such as air or vacuum for fast response, or oil or other viscous material, for slow response. Furthermore, as seen in FIG. 1, a deactivating switch 32 may be employed with the present digital watch. This is an auxiliary switch which may completely deactivate the display and may be utilized when the watch is not worn.

The mercury droplet 16 is confined in the curved tube 14 and behaves in a pendulum-like manner, so that it is always seeking the lowest point in the tube. It has been observed that this configuration is ideally suited for normal human motion, and as the wearer of the watch swings his arm through small angles, such as in walking, the droplet 16 oscillates in the area 14*a* of the curved tube 14. Of course, these oscillations are dampened by the air or fluid within the tube and the mercury droplet does not reach the contacts in the location 14*c* in the tube 14. However, if the user's arm is raised for any reason, the droplet 16 will move and become inherently stable at point 14*b* in the tube 14. Thereafter, in order to dislodge the droplet from the inherently stable position 14*b*, the wearer's arm must either be lowered which thus returns the droplet to the neutral region around 14*a*, or the wrist twisted slightly toward the body. This latter motion causes the droplet to flow to position 14*c* in the tube 14, thereby closing the electrical circuit and activating the display. It should be observed that a slight twisting movement of the wrist is the precise motion employed by watch wearers when they desire to look at their wrist watches. Furthermore, the property of mercury, when it is in contact with the surface it does not wet, permits the activation of multiple contacts, as seen in FIG. 4. Thus, the first contact to close is the contact 26 for the viewing of time. Thereafter, a slight twist of the wrist toward or away from the body activates the other set of contacts 28 or 30, respectively.

FIGS. 5 and 6 are another embodiment of the present invention in which the time, seconds and date circuits are provided with respective indentations 34, 36 and 38 into which the mercury droplet 16, or a substitute metal ball, falls in order to actuate the respective contacts 40, 42, or 44. A ground plate 46 is shown which provides the ground contact for the mercury droplet when it is in engagement with any of the above contacts 40, 42, or 44.

In this connection, it must be noted that there are three boundaries in which surface films exist. The boundary between a solid wall and a liquid, a liquid and a gas, and a solid and a vapor. The three boundaries and their accompanying films are shown schematically in FIG. 8. The films are only a few molecules thick, and associated with each film is an appropriate surface tension. Thus, $\gamma$ SL = surface tension of the solid-liquid film;
$\gamma$ SV = surface tension of the solid-vapor film;
$\gamma$ LV = surface tension of the liquid-vapor film.

The curvature of the surface of liquid near a solid wall depends upon the difference between $\gamma$ SV and $\gamma$ SL. Consider a portion of a glass wall in contact with mercury, as shown in FIG. 9. At the wall the three films meet. If we isolate a small portion of all three films at their junction and imagine the films to extend a unit distance in the direction perpendicular to the diagram, the isolated portion will be in equilibrium under the action of four forces, three of which are the surface tensions of the three films. The fourth force A is an attraction between the isolated portion and the wall, and is called the adhesive force. Applying the conditions for equilibrium yields $$\Sigma Fx = \gamma LV \sin\theta - A = 0,$$

$$\Sigma Fy = \gamma SV - \gamma SL - \gamma LV \cos\theta = 0$$

from which $$A = \gamma LV \sin\theta$$

$$\gamma SV - \gamma SL = \gamma LV \cos\theta$$

The first equation enables calculation of the adhesive force from measurement of $\gamma$ LV and the angle $\theta$, known as the contact angle. The second equation shows that the contact angle, which is a measure of the curvature of the liquid-vapor surface adjacent to the wall, depends on the difference between $\gamma$ SV and $\gamma$ SL.

In FIG. 9, a glass wall is in contact with mercury. The contact angle $\theta$ is about 140°, cos $\theta$ is negative, and hence $\gamma$ SV is less than $\gamma$ SL. When $\theta$ lies between 90° and 180°, as it does here, the liquid does not wet the glass.

FIG. 10 shows the shape of a droplet of mercury on a surface it does not wet, and the 140° angle is clearly seen. The droplet has the appropriate configuration for reliable making of the circuits of the LED digital wrist watch when the wearer's arm and wrist is moved and turned in the predetermined direction and orientation.

It is within the scope of the present invention to provide a curved tube 14 fabricated of other non-wetting substances, for example, aluminum, stainless steel, carbon steel or tungsten steel. It is also within the scope of the present invention to provide a means for automatically switching on the light source for illuminating the display of an LCD digital watch. This means may take the form of a mercury switch arrangement as hereinbefore disclosed. Furthermore, such a means for automatically switching on a light source, for example by hand and arm movement, can be utilized for illuminating the fact of an ordinary watch having hour and minute hands. It should also be mentioned that an enclosure with a movable contact activating means may form an automatic switch for a digital watch and the enclosure may have a configuration that is so chosen that the switching functions will be performed upon the appropriate movement of the wearer's hand and arm.

What is claimed:

1. In a digital wrist watch a watch housing, a display means in said housing, a mercury switch for automatically activating the various display circuits for the functions of the digital watch, said mercury switch including a curved tube having a droplet of mercury therein, means for moving said curved tube to a limited degree in a curved plane to thereby adjust for individual viewing angles of said digital wrist watch, and electrical contacts in predetermined location in said tube whereby when the wearer of the wrist watch raises and turns his hand and forearm to a normal viewing position, said mercury droplet, in response to a gravitational pull, moves to a position into engagement with said electrical contacts thereby activating one of said functions and said display means.

2. In a digital wrist watch a watch housing, a display means in said housing, said display means including a prismatic lens having separate viewing surfaces for the separate functions of said watch, a mercury switch for automatically activating the various display circuits for the functions of the digital watch, said mercury switch including a curved tube having a droplet of mercury therein, and electrical contacts in predetermined location in said tube whereby when the wearer of the wrist watch raises and turns his hand and forearm to a normal viewing position, said mercury droplet, in response to a gravitational pull, moves to a position into engagement with said electrical contacts thereby activating one of said functions and said display means.

3. A digital wrist watch as claimed in claim 1 wherein said means for moving said curved tube in said watch housing is a rack and pinion assembly.

4. A digital wrist watch as claimed in claim 1 wherein said curved tube is constituted of a non-wetting material.

5. A digital wrist watch as claimed in claim 4 wherein said curved tube is glass.

6. A digital wrist watch as claimed in claim 4 wherein said curved tube is Teflon.

7. A digital wrist watch as claimed in claim 1 wherein said curved tube is mounted in said watch housing at a slight angle to the horizontal plane so that when said wrist watch is at rest on a substantially planar surface said mercury droplet is not in contact with said electrical contacts.

8. A digital wrist watch as claimed in claim 1 further comprising a separate disabling switch for deactivating said various display circuits.

9. A digital wrist watch as claimed in claim 1 wherein said curved tube is provided with internal indentations and whereby said electrical contacts are positioned in said indentations.

10. In a digital wrist watch a watch housing, a display means in said housing, a switch for automatically activating various display circuits of the functions of the digital watch, said switch including a curved sealed tube having an electrical conductive sphere therein, said tube being provided with internal indentations therein, and electrical contacts located in each of said indentations whereby when the wearer raises and turns his hand and forearm to a normal viewing position said sphere, in response to gravitational pull, moves to a position into engagement with selected electrical contacts thereby activating one of said functions and said display means.

11. A digital wrist watch as claimed in claim 1 having a plurality of pairs of electrical contacts for selected functions, each pair of said contacts being activated separately by changing the orientation of the wearer's hand and forearm.

12. A digital wrist watch as claimed in claim 1 wherein a wall of said curved tube is metallic thereby forming one of said electrical contacts.

13. A digital wrist watch as claimed in claim 1 wherein said curved tube is sealed and filled with a medium that can be selected in accordance with the desired response time of movement of the mercury droplet from a given position to said position into engagement with said electrical contacts.

14. A digital wrist watch as claimed in claim 1 wherein said watch is an LCD type having a normally inoperative light source for the display means, said mercury switch being operative when the wearer of the wrist watch raises his hand and arm to automatically operate said light source.

* * * * *